United States Patent [19]

Scott

[11] 4,441,268

[45] Apr. 10, 1984

[54] PICTURE FRAMING DEVICE

[76] Inventor: Doug Scott, 7081 Great Oaks Rd., Germantown, Tenn. 38138

[21] Appl. No.: 399,315

[22] Filed: Jul. 19, 1982

[51] Int. Cl.[3] ..... G09F 1/12

[52] U.S. Cl. ..... 40/152.1; 40/156; 40/10 D

[58] Field of Search ..... 40/10 D, 10 R, 152, 40/156, 152.1

[56] References Cited

U.S. PATENT DOCUMENTS

| | | | |
|---|---|---|---|
| 634,146 | 10/1899 | Maddox | 40/152.1 |
| 1,202,589 | 10/1916 | Roosman | 40/10 D |
| 1,220,418 | 3/1917 | Hawkes | 40/156 |
| 3,200,527 | 8/1965 | Clark | 40/152 |
| 4,216,936 | 8/1980 | Deselms | 40/152.1 |

*Primary Examiner*—Gene Mancene
*Assistant Examiner*—Wenceslao J. Contreras
*Attorney, Agent, or Firm*—Richard P. Crowley

[57] ABSTRACT

A picture framing device comprising a mainbody piece, a backplate piece, and a support bracket. The mainbody piece includes a true frame portion, a lens portion, and a rearward confinement depression. The backplate piece has an extremely precise shape commensurate with the confinement depression for very close fitting reception therein. The peripheral edges of the backplate are smooth and include structure for providing an invisible union with the mainbody. Each piece is integrally formed from a transparent acrylic plastic substance via an injection molding process. Also included is structure to interlockably engage the pieces one with another. The support bracket includes structure to provide optimum support for the device, although it is not utilized when the device is to be wall-mounted since its purpose is for supporting the device in its upright position on a desk or the like.

A method for cropping a large pictorial web of material down to a smaller predetermined size for ultimate precise reception within the confines of the confinement depression is further disclosed. The method involves moving the clear backplate over the large web while viewing therethrough and thus selecting the most desirable small pictorial arrangement and for subsequently utilizing the backplate as a precision template for guiding a knife along the smooth edges thereof in actually effecting the cropping action, thus establishing a smaller precision fitting picture or the like for the confinement depression.

21 Claims, 14 Drawing Figures

PICTURE FRAMING DEVICE

BACKGROUND OF THE INVENTION

1. Field of the Invention:

This invention relates to the field of picture framing devices and is particularly directed toward picture framing devices constructed from plastic.

2. Description of the Prior Art:

Applicant is familiar with the following U.S. Pat. Nos.: 737,124 and 1,338,441. Neither of these patents is deemed by applicant to suggest nor disclose his device.

Numerous picture framing devices constructed from plastic have heretofore been developed and marketed with a reasonable degree of success. However, certain limitations have prevailed in the state of the art of picture framing since it has heretofore been mistakenly believed by those skilled in this picture framing art that plastic must, by necessity, be first constructed in individual pieces which are subsequently joined one with the other. It is well-known to those skilled in this particular art that this practice has certain disadvantages, among which are: First, the degree of clearness has left something to be desired. Second, the several individual pieces of clear plastic cannot be joined without leaving telltale junction marks. These shortcomings, of course, distract greatly from the overall aesthetic effect of the device. Third, it is well-established that cost factors are usually directly proportionate with the number of pieces, therefore, when reducing the number of pieces required for the type device, we would reduce the fabrication costs considerably.

It is deemed significant to point out that one skilled in the art of picture framing would usually not be at all acquainted with the latest state of the art pertaining to the field of plastic molding. Moreover, the knowledge recently acquired by the applicant in combining the two distinctly remote fields of art has contributed greatly in bringing the present invention into a reality. More specifically, plastic picture framing artisans have, heretofore, purposely avoided constructing what is known in the art as a true frame from clear plastic, since it was widely considered to be virtually impossible to eliminate the unattractive junction lines of the various pieces and because conventional means for securing the picture in place would be visible from the face side.

SUMMARY OF THE INVENTION

The present invention is directed toward overcoming the disadvantages and problems relative to previous picture framing devices, particularly the problems of (1) eliminating the telltale junction marks and other unsightliness on the true frames when constructed of clear plastic, and also conventional means for securing the picture in place would be visible from the face side, and (2) the economical advantages of injection molding as opposed to other techniques, thus minimizing the production costs, i.e., achieved mainly by reducing the number of pieces required to construct such a device.

The device of the present invention is intended for providing a displayable enclosure for various items of the types having aesthetic or functional value, e.g., photographs as well as currency and postage stamp arrangements, horologic devices and the like. The instant device comprises a mainbody member which integrally includes a frame portion for establishing a marginal border of embellishment surrounding the aesthetic item intended to be displayed or providing what is known in the state of the art of picture framing as a true frame. The mainbody also includes a lenslike portion integrally joined to the frame portion for providing an obverse protective transparent cover for the aesthetic item intended to be displayed. In addition, the mainbody member includes a confinement portion integrally joined to the frame and lens portions and which defines a depression into which the aesthetic item intended to be displayed may be received.

The device also includes a backplate member preferably rigidly constructed and having a size and shape compatible with the depression of the confinement member for nestled reception within the depression and for contiguous engagement with the reverse side of the aesthetic item. Additionally, the backplate member preferably is constructed in such fashion that all the edges are smooth so as to better facilitate its use as a template. In this manner, the obverse side of the aesthetic item is caused to assume a contiguous engagement with the reverse side of the lens portion. However, for certain reasons it may be desirable that the backplate member not be so rigid. Therefore, applicant anticipates an optional backplate member which is semi-rigid or somewhat flexible in construction and which is deemed to be commensurate with this disclosure. The device is also characterized by incorporating interlockable structure which is established jointly by cooperatively acting portions of the confinement portion of the mainbody member and the backplate member for readily causing the backplate member to be adequately locked in place within the confinement portion, while remaining invisible from the front.

The device also includes a brace member which is removably engageable with the backplate member via cooperative dovetail elements so as to enable the brace member to rigidly engage the backplate member and to provide support in supporting the device in an upright position as it is restingly supported upon a desktop or the like. However, this brace member is deleted when the device is to be wall-mounted.

Also, disclosed herewith is a method for cropping a large pictorial arrangement down to a smaller size for ultimate reception within the confines of the confinement portion or depression. The method of the present invention generally involves utilizing the clear backplate member as a template for facilitating a trial-and-error method of moving the backplate member over the large pictorial arrangement until the most desired viewed small pictorial arrangement is chosen. The backplate member is subsequently utilized as a template for guiding a knifelike tool along the edges thereof in actually effecting the cropping action.

DESCRIPTION OF THE DRAWINGS

FIG. 9 is intended to readily show structure to be identified as adjustment means.

DESCRIPTION OF THE PREFERRED EMBODIMENT

Figure 1:
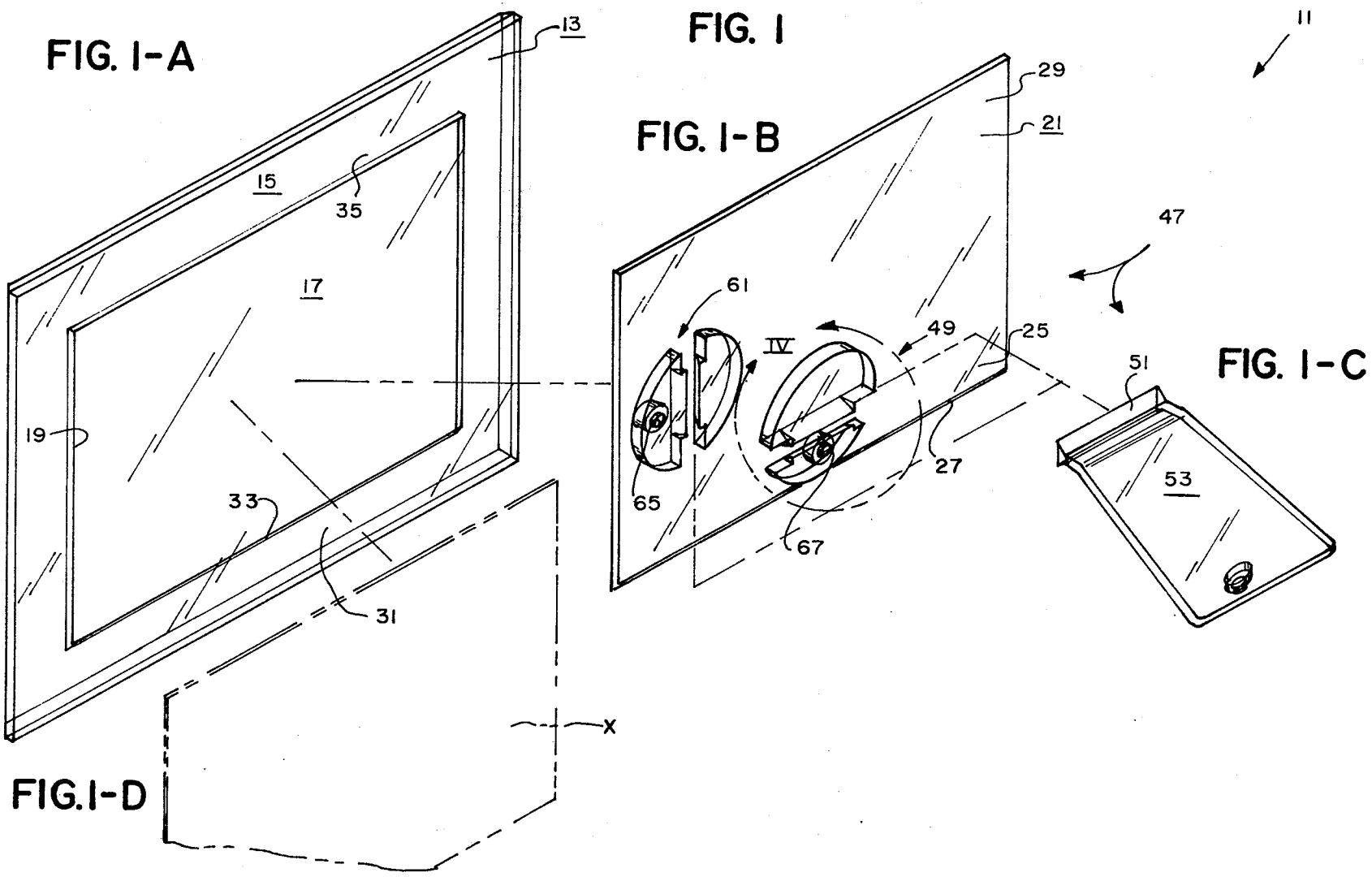
FIG. 1 is an exploded view of the device in its entirety wherein FIG. 1-A depicts the mainbody member, FIG. 1-B depicts the backplate member, FIG. 1-C depicts the brace member, and FIG. 1-D is intended to depict an aesthetic item, e.g., a photograph or the like which is intended to be displayed within the device.

The device 11 is intended to be used in providing a displayable enclosure for various items of the types having aesthetic or functional value, e.g., photographs, stamps, currency, horologic devices and the like which will simply be characterized in the drawings by the letter X. The device 11 is characterized by incorporating mainbody means, as at 13, which is best shown in FIG. 1-A of the drawings and includes the following: (1) frame means, as at 15, for establishing a marginal border of embellishment surrounding the aesthetic item X intended to be displayed, (2) lenslike means, as at 17, which is integrally joined to the frame means 15 for providing an obverse protective transparent cover for the aesthetic item X intended to be displayed, and (3) confinement means, as at 19, which is integrally joined to the frame means 15 and the lenslike means 17 for receiving and confining—at least in part—the aesthetic item X intended to be displayed. The confinement means 19 may best be viewed in FIGS. 6 and 9 of the drawings and will be more fully disclosed as the specification proceeds.

It will be understood that the term lenslike as used herein will include transparent structure having: two surfaces of different curvature; one surface curved and one planar surface; or two planar surfaces.

The device 11 also includes backplate means, as at 21 shown in FIG. 1-B of the drawings, for nestled reception within the confinement means 19 and for contiguous engagement with the reverse side of the aesthetic item X. The device 11 also includes interlockable means generally indicated at 23 and best shown in FIG. 9 of the drawings. The means 23 is established jointly by cooperatively acting portions (to be fully described as the specification proceeds) of the confinement means 19 and the backplate means 21 for readily causing the backplate means 21 to be adequately locked in place within the confinement means 19. Thus, it will readily be seen that the shape of the confinement means 19, being an important feature, is commensurate with the shape of the lenslike means 17. Indeed, the confinement means 19 is defined—at least in part—by the reverse side of the lenslike means 17, i.e., the confinement means 19 defines a depression having a bottom defined by the reverse side of the lenslike means 17 and a continuous wall having important features to be introduced later in the specification.

Figure 2:
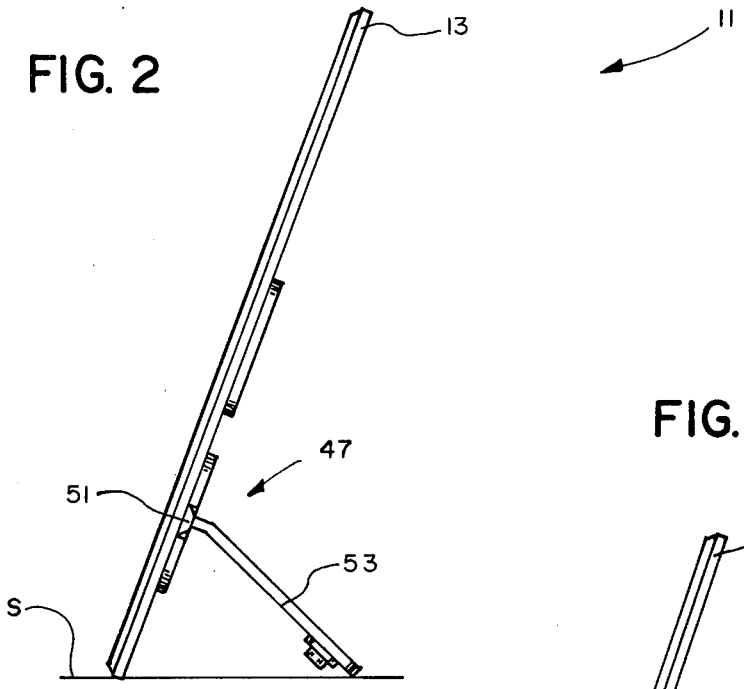
FIG. 2 is a side elevational view of the device in one arrangement, i.e., restingly supported upon a table or the like, and the mainbody member of this embodiment is oblong-shaped and the minor axis thereof is arranged so as to be parallel with the supporting surface upon which the device is restingly supported.
Figure 3:
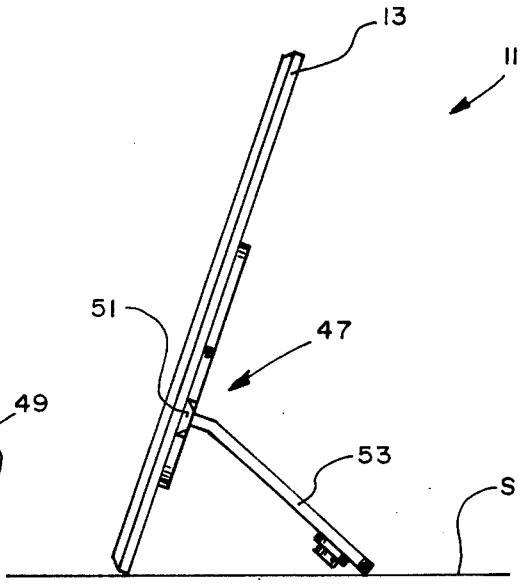
FIG. 3 is a view similar to FIG. 2 except the oblong-shaped device is now arranged so that the major axis thereof is parallel with the supporting surface.

In addition, it may readily be seen that when the lenslike means 17 is constructed so as to be planar as shown in FIGS. 2 and 3 of the drawings, the backplate means 21 will cause the obverse side of the aesthetic item X to assume a contiguous engagement with the reverse side of the lenslike means 17 in providing an optimum display of such item X. However, it should be understood that as mentioned above, the shape of the lenslike means 17 may depart from the planar configuration or be configurated to conform to a somewhat bulbous shape or other geometrical forms as desired. Likewise, the lenslike means 17 and/or indeed the frame means 15 may either or both take on shape(s) other than the rectangular shape shown, e.g., circular, hexagon, oval, etc.

It will be appreciated by those skilled in the art that when constructing frame and lens structure from a clear substance, a particular problem immediately surfaces which involves how to avoid the unsightliness of conventional means for locking the backplate to the frame structure, i.e., the clear structure would allow the conventional locking means to show through.

Figure 6:
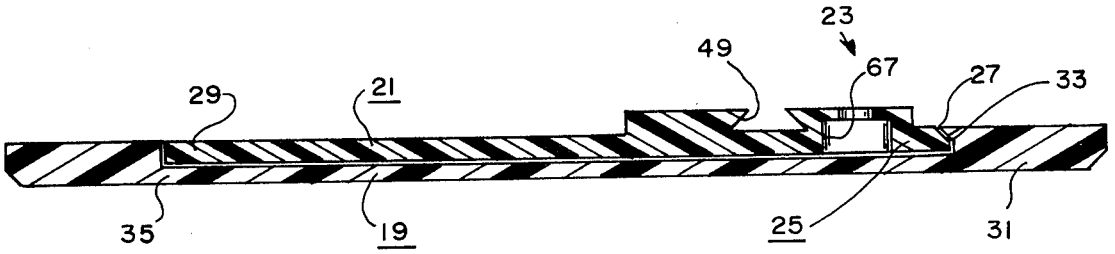
FIG. 6 is an enlarged sectional view taken as on the line VI—VI of FIG. 5.
Figure 9:
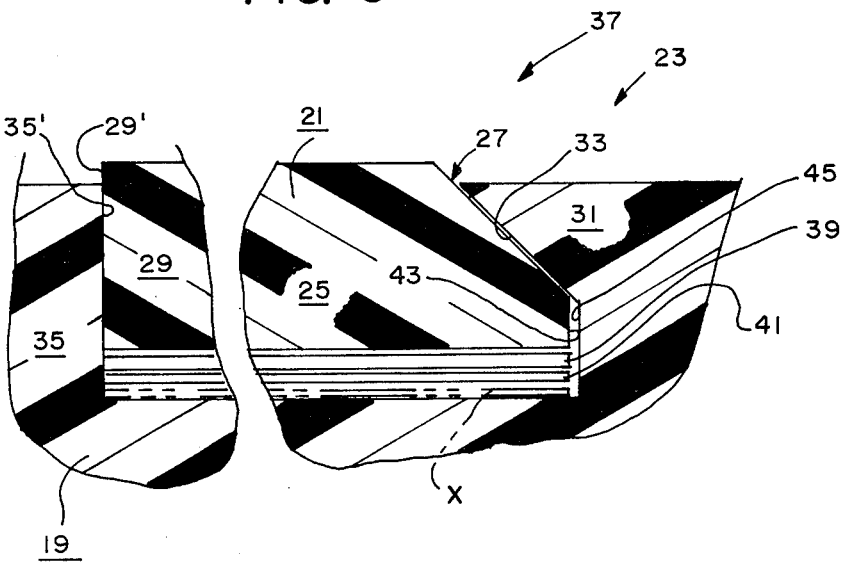
FIG. 9 is a greatly enlarged partial view of certain structure as depicted in FIG. 6, although

Particular attention will now be directed toward FIGS. 6 and 9 wherein it may be seen that the device 11 obviates the just-mentioned problem, i.e., unsightly locking means, since the interlockable means 23 alluded to above includes configurating a first marginal portion, as at 25, of the backplate means 21 so as to terminate along a chamfered portion, as at 27, while a remotely disposed second portion, as at 29, thereof is configurated so as to substantially define a right angle. The interlockable means 23 also includes similarly configurating a first portion, as at 31, of the confinement means 19 so as to define an undercut portion, as at 33, which is compatibly shaped with the chamfered portion 27, while a remotely disposed second portion, as at 35, of the confinement means 19 is configurated so as to substantially define a right angle, i.e., achieving an opposed-bevel arrangement which is an important feature of this invention. The interlockable means 23 also includes configurating the respective distances between the first and second portions (25, 29 respectively) of the confinement means 19 so as to establish an optimum registration of the backplate means 21 within the confinement means 19. In this manner, the backplate means 21 is readily enabled to be adequately held in place. Additionally, the backplate means 21 is provided with perfectly smooth edges to aid in avoiding the unsightly condition as identified above. More specifically, the right angularly disposed second portions, i.e., a second portion, as at 29 in FIG. 9, of the backplate means 21 and a second portion, as at 35 in FIG. 9, of the confinement means 19 would ideally frictionally engage one another when optimum registration is achieved. In addition, it will be seen later in the specification that the backplate means 21 serves a multi-purpose one of which is that it may be used for the specific purpose of preparing the aesthetic item X to precisely fit the frame means 15. Moreover, the backplate 21 is always readily available, since it always travels with the mainbody 13.

Further, the interlockable means 23 preferably includes adjustment means, as at 37 and best viewed in FIG. 9 of the drawings, for adjusting within limits the degree of frictional engagement of the backplate means 21 with the confinement means 19, i.e., so as to readily achieve an ideal engagement even under varying conditions.

More specifically, the adjustment means 37 includes planar shim means, as at 39, for insertion between the backplate means 21 and the reverse side of the aesthetic item X to be displayed.

The shim means 39 may further be characterized as comprising at least one web of material (although a plurality of webs of material may be used as at 39, 41 or as shown in FIG. 9) which preferably has/have a size and shape substantially identical to that of the aesthetic item X intended to be displayed. While the thickness of the shim means 39, 41 will not be limited to such, it will be appreciated that typical bond paper, and the like, has been used successfully for this purpose. Therefore, it may readily be seen that the extra thickness (which may be ever-so-thin) established by the shim means or web(s) of material 39, 41 is effective in causing the chamfered portion 27 to ride higher in the undercut portion 33. This feature is effective in urging the second portion 29' (of the backplate means 21) to move slightly to the left (as viewed in FIG. 9) or toward the second portion 35' (of the confinement means 19) thus causing the second portion 29' to have a greater degree of frictional engagement with the second portion 35' (of the confinement means 19). However, it will be understood that in certain situations the shim means 39, 41 may be deleted; and in which situation, the thickness of the aesthetic item X intended to be displayed would have the same effect as the shim means. In addition, well-known "mat" structure may be used in lieu of the shim means for accomplishing the two-fold purpose of shim means as well as mat means or simply for the single purpose of mat structure.

It will now be noted that the chamfered portion 27 of the backplate means 21 does not define the absolute termination of the first portion 25 thereof, but rather the terminus thereof defines a right angle portion, as at 43. Similarly, the first portion 31 defining the undercut portion 33 preferably includes a right angle portion, as at 45. The significance of these right angle portions 43, 45 will be expounded upon later in the specification.

The device 11 includes first support means, as at 47 and best shown in FIGS. 1-B and 1-C of the drawings, for supporting the device 11 in an optimum upright position while being restingly supported upon a horizontally disposed planar surface, e.g., a desk or table top or the like characterized in FIGS. 2 and 3 simply by the letter S.

The first support means 47 alluded to above includes a pair of dovetail elements constituting first and second dovetail elements, as at 49, 51, and brace means, as at 53, which is removably engageable with the backplate means 21 via the pair of cooperative dovetail elements 49, 51. Moreover, the first dovetail element 49 is affixed to the backside of the backplate means 21 and the second dovetail element 51 is affixed to the brace means 53. In this manner, the brace means 53 is enabled to rigidly engage the backplate means 21 and to provide the support for the device 11. It is significant to note that the dovetail element 49 is integrally formed with the backplate means 21 and the dovetail element 51 is integrally formed with the brace means 53.

Figure 4:
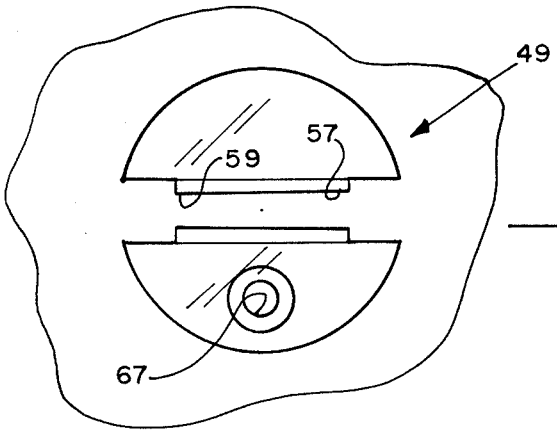
FIG. 4 is an enlarged partial view of the area circumscribed in FIG. 1-B by the line IV.

It should be noted that the first dovetail element 49 as disclosed herewith is a female element while the second dovetail element 51 is a male element which may readily slide within the female dovetail element 49. Moreover, the female dovetail element 49 preferably is in the form of a slot which includes a broad entrance end, as at 57 in FIG. 4 of the drawings, which leads to a narrow end, as at 59 therein. In this manner, the male dovetail element 51 may be urged to assume a wedged position within the female element 49, thus enhancing the marriage of the two elements.

The first support means 47 also includes a third dovetail element, as at 61 in FIG. 1-B of the drawings, which is substantially identical with the above-described first dovetail female element 49. Therefore, it is deemed to be unnecessary to separately expound upon the details of the third element 61 since such would merely be repetitious. However, the purpose of providing the two female elements 49, 61 is to enable the device to be positioned in either of the two upright positions as shown in FIGS. 2 and 3 of the drawings, i.e., in FIG. 2 of the drawings the minor axis of the oblong frame means 15 is substantially parallel with the supporting surface S while in FIG. 3 of the drawings the major axis thereof is substantially parallel with the supporting surface S.

Figure 8:
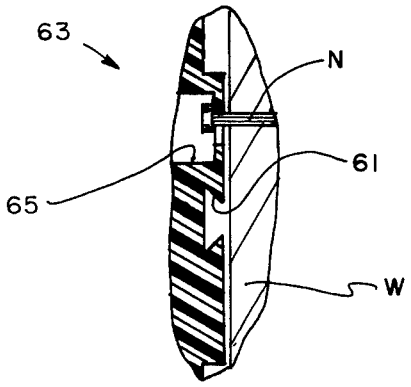
FIG. 8 is an enlarged sectional view taken as on the line VIII—VIII of FIG. 7, although it is shown in FIG. 8 as it would appear when the device has actually been wall-mounted, i.e., the device is shown suspended from a nail driven into the wall.

Particular attention will now be directed toward FIG. 8 of the drawings wherein it may be seen that the device 11 includes second support means, as at 63, for facilitating mounting the device 11 upon a vertical wall surface characterized simply by the letter W.

Figure 5:
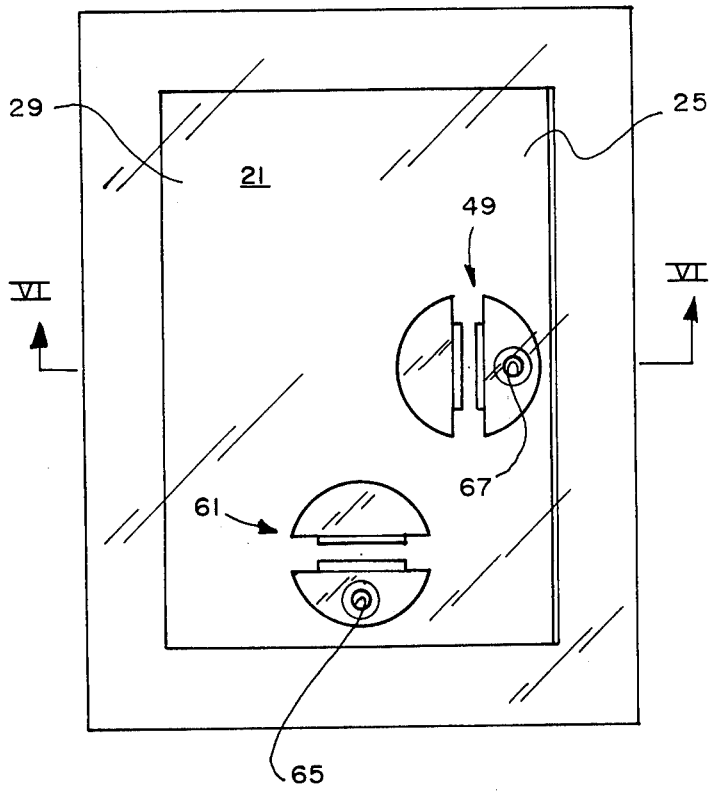
FIG. 5 is a rear elevational view of another arrangement or configuration of the device wherein it is intended to subsequently be wall-mounted.
Figure 7:
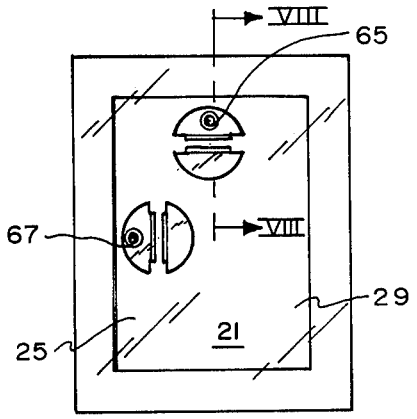
FIG. 7 is a reduced view similar to that shown in FIG. 5 with the difference being that the device shown in FIG. 7 has been rotated 180°, so as to place it in one of the proper positions for being wall-mounted.

The second support means 63 alluded to above includes providing the backplate means 21 with at least one socket, as at 65, for receiving suitable nail-like structure, e.g., like the nail N, which may have been driven into the wall W for such purpose. In this manner, the device is enabled to be supported from the nail-like structure N. From FIGS. 5 and 7 it should be noted that a second socket, as at 67, preferably is included to enable the device 11 to be mounted on the wall surface W in either a vertical or horizontal position or arranged substantially as suggested in FIGS. 2 and 3 of the drawings and explained above. Here again, since the second socket 67 is substantially identical with the first mentioned socket 65, it is deemed to be unnecessary to separately expound upon the details thereof.

It should be understood that the first dovetail element 49 and the second socket 67 are both situated on the backplate means 21 so as to be in proximity to the first portion 25 thereof, i.e., adjacent the chamfered portion 27. In this manner, any tendency of the interlockable means 23 to be degraded in either arrangement of the device 11 is negated. In other words, if the first dovetail element and/or the second socket 67 were to be placed in proximity to the remotely disposed portion 29 of the backplate means 21, the effectiveness of the interlockable means 23 might be adversely affected, i.e., particularly if the device 11 were to be wall-mounted. Of course, any tendency of the mainbody means 13 to inadvertently become disengaged from the backplate means could still be obviated by proper application of the adjustment means 37.

It will be appreciated by those skilled in the art of injection molding that at least the mainbody means 13 is formed from a transparent clear acrylic plastic substance and the mainbody means 13 is integrally formed by an injection molding process well-known to those skilled in this art. Moreover, applicant believes that certain advantages may be gained by also constructing the backplate means 21 and the brace means 53 from a transparent clear acrylic plastic substance which preferably is integrally formed by the injection molding process.

Furthermore, it will also be appreciated by those skilled in the art that, if desired, the device 11 may be substantially permanently sealed. More specifically, a few drops of a suitable solvent, e.g., acetone or the like, may simply be placed anywhere, at random, along the junction of the backplate means 21 and the confinement means 19, i.e., subsequent to properly placing the aesthetic item X therein. In this fashion, an embedment may readily be established for permanently encasing certain items, e.g., an arrangement of postage stamps and the like, since the solvent is effective in acting upon the plastic substance for establishing a virtually permanent bond between the backplate means 21 and the confinement means 19.

Method Disclosure

Figure 10:
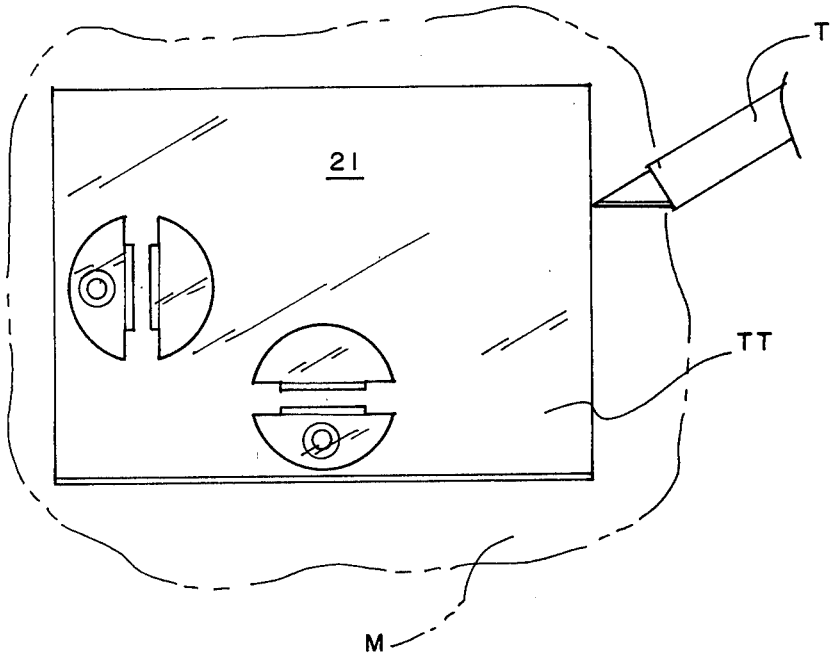
FIG. 10 depicts a portion of the device, i.e., the structure shown in FIG. 1-B, in an arrangement for accomplishing a method disclosed herewith which utilizes structure shown in FIG. 1-B as a template for guiding a knifelike device in cropping a large web of material down to a smaller predetermined size.

The method of utilizing certain structure of the present invention for accomplishing a desired end result is disclosed herein. The method alluded to is for readily accomplishing the task of cropping a large pictorial web of material, as characterized by the letter M in FIG. 10 of the drawings, down to a smaller precisely formed predetermined size for ultimate reception within the confines of the displayable enclosure of the device 11. The method comprises the steps of:

(1) providing a large pictorial web of material M intended to be cropped, (2) providing a sharp knifelike tool, characterized by the letter T in FIG. 10 of the drawings, for eventually accomplishing the cropping action therewith, (3) providing the displayable enclosure or the device 11 within which the smaller precisely formed predetermined size of web material M is intended to ultimately be placed; the displayable enclosure 11 includes the previously described confinement structure 19 having a size and shape precisely identical to that of the smaller precisely formed predetermined size of web material, and the previously described backplate structure 21 also having a size and shape precisely identical to that of the smaller precisely formed predetermined size of web material, i.e., the backplate structure 21 being removably received within the confinement structure 19 as previously described, (4) removing the backplate structure 21 from the confinement structure 19 and subsequently overlaying it upon the selected area intended to ultimately constitute the smaller predetermined size, (5) utilizing the edges of the backplate structure 21 as a template tool, characterized by the letters TT in FIG. 10 of the drawings, in properly guiding the provided knifelike tool T along the edges thereof in effecting the actual cropping action of the web of material M, (6) placing the smaller precisely formed predetermined size of web of material within the confinement structure 19 prior to replacing the backplate structure 21 therein, and (7) actually replacing the backplate structure 21 within the confinement structure 19.

In accomplishing the method herein disclosed, the backplate structure 21 preferably is transparent for presenting to view an infinite number of pictorial arrangements by merely shifting the backplate structure 21 to various different locations over the large web of material M. prior to actually effecting the cropping action thereof, thus aiding in selecting the absolutely most desirable pictorial arrangement which will ultimately constitute the smaller precisely formed predetermined size intended to be enclosed in the device 11.

The template tool TT preferably terminates along all four sides thereof in substantially right angles so as to effectively guide the knife T when accomplishing the cropping action. Moreover, as mentioned previously in the disclosure, the chamfered portion 27 does not define the absolute terminus of the first portion 25. It will be appreciated by those skilled in the art of picture framing that to utilize a template which terminates at a chamfered terminus presents the likelihood of the knife T riding up on the template TT, which in this case, would deface the template TT as well as negate the cropping action.

It should be pointed out that when preparing a picture or the like for conventional picture frames, the cropping action, per se, is not critical since the frame provides an obscurity for the marginal portion of the picture. However, in practicing this invention, the cropping action must be extremely accurate, resulting in a picture that will precisely fit into the confinement structure, i.e., since nothing is hidden from view, preciseness is deemed imperative, thus, the backplate structure, as disclosed herein, is an important feature of this invention.

Therefore, it will be appreciated that the main feature of this invention is that applicant has developed a technique that, in the past, presented unsurmountable obstacles, and which achieves an end result of a picture framing device that is seemingly flawless and is definitely a beautiful sight to behold.

Although the invention has been described and illustrated with respect to a preferred embodiment thereof, it should be understood that it is not intended to be so limited since changes and modifications may be made therein which are within the full intended scope of the invention.

I claim:

1. A picture framing device for displaying an enclosure, which device comprises:

(a) frame means for establishing a marginal border surrounding the enclosure to be displayed;

(b) lens-like means integrally joined to the frame means to provide an obverse, protective, transparent cover for the enclosure to be displayed;

(c) confinement means comprising the frame means and lens-like means to define a depression containing marginal edges thereabout into which depression the enclosure is inserted for display through the lens-like means;

(d) rigid backplate means for nestled reception of the backplate means within the depression to retain the enclosure in the depression;

(e) interlocking means to retain the backplate means in a frictional, nestled relationship within the depression and into a close retaining contact with the back of the enclosure, which interlocking means comprises an undercut marginal edge and an opposite remotely-spaced straight edge in the confinement means and a chamfered marginal edge and an opposite remotely-spaced straight edge in the backplate means, the undercut edge and the chamfered edge generally matingly compatible to provide cooperative frictional engagement of the undercut and chamfered edge together when the chamfered edge is inserted beneath the undercut edge and close, cooperative, frictional engagement of the said straight edges, thereby retaining the backplate means in a close, nestled relationship within the depression by cooperative frictional engagement when placed in back of the enclosure.

2. The device of claim 1 wherein all means are composed of a clear plastic material.

3. The device of claim 1 wherein all of the means are precision formed and composed of an injected molded clear acrylic plastic material.

4. The device of claim 1 wherein the lens-like means has two planar spaced-apart surfaces.

5. The device of claim 1 wherein the confinement means comprises a generally rectangular depression surrounded by four edges and includes a one edge having the said undercut edge to receive the said chamfered edge of the backplate means, the other edges of the confinement means and the other edges of the backplate means being straight and generally perpendicular to the plane of the depression, the edges in a close, engaging relationship when the backplate means is frictionally nestled in the depression.

6. The device of claim 1 wherein said backplate means has a chamfered edge portion extending along the substantial length of one edge, and said confinement means has an undercut edge portion extending along the substantial length of one edge so that the undercut and chamfered edges are matingly engaged for the insertion and removal of the backplate means in the depression.

7. The device of claim 1 wherein the chamfered and undercut edges have an angle of about 45°.

8. The device of claim 1 wherein the confinement means comprises an undercut edge portion along one edge of the depression, and which undercut edge does not extend to the full depth of the depression and has a generally straight right angle wall portion and wherein the backplate means has a chamfered edge, which edge does not extend to the full edge width of the backplate means and has a generally straight right angle wall portion.

9. The device of claim 1 which includes shim means for adjusting the degree of frictional engagement of said backplate means within said confinement means.

10. The device of claim 9 wherein said shim means includes a shim material for insertion between the backplate means and the reverse of the enclosure to cause the chamfered edge to ride higher against the undercut edge and to urge the backplate means into a closer frictional engagement within the confinement means.

11. The device of claim 1 which includes support means for supporting the picture framing device in an upright position on a planar surface, and which support means comprises a brace element and a pair of cooperative dovetail elements, which dovetail elements are spaced apart and secured to the back of the backplate means to define a space therebetween, one end of the brace element slideably engaged between the dovetail elements to position the brace element at an angle for support for the picture framing device.

12. The device of claim 11 which includes first and second support means on the back surface of the backplate means, one end of the brace element slideably engaged between dovetail elements of either the first or second support means to provide support in a desired direction for the picture framing device.

13. The device of claim 12 wherein the first and second supports include a socket-type element having a hole therein adapted to receive an insertion for securing the picture framing device to a wall.

14. The picture framing device of claim 1 which includes therein a displayable sheet material enclosure, the displayable enclosure retained in position within the depression by the backplate means.

15. The device of claim 11 wherein the brace element has an angle therein toward one end thereof, the other end having a raised ridge-like element adapted to be slid in a mating engagement between the dovetail elements on the backplate means.

16. A picture framing device for displaying an enclosure, which device comprises:

(a) a clear plastic frame means for establishing a marginal border surrounding the enclosure to be displayed;

(b) a clear plastic lens-like means integrally formed and joined to the frame means to provide an obverse, protective, transparent cover for the enclosure to be displayed;

(c) confinement means comprising the frame means and lens-like means which together define a depression containing four marginal edges thereabout into which depression the enclosure is inserted for display through the lens-like means;

(d) a plastic rigid backplate means for nestled reception of the backplate means within the depression to retain the enclosure in the depression;

(e) interlocking means to retain the backplate means in a frictional, nestled relationship within the depression and into a close retaining contact with the back of the enclosure to be displayed, which interlocking means comprises an undercut marginal edge and a right angle wall portion extending therefrom and an opposite remotely-spaced straight edge in the confinement means and a chamfered marginal edge and a right angle wall portion extending therefrom and an opposite remotely-spaced straight edge in the backplate means, the undercut edge and the chamfered edge and the respective opposite edges in a close, cooperative, frictional engagement within the depression so as to retain the backplate means in a close, nestled, and frictional relationship within the depression; and (f) support means to place the device in a displayable position.

17. The device of claim 16 wherein the frame means, the lens-like means, the backplate means, and the support means are composed of a clear acrylic plastic material.

18. The device of claim 16 which includes a shim means which provides for adjusting the degree of frictional engagement of the said backplate means within the said confinement means by causing the chamfered edge to ride higher against the undercut edge.

19. The device of claim 16 wherein the support means comprises a pair of cooperative dovetail elements which are spaced apart and secured to the back of the backplate means to define a space therebetween and a plastic brace element, one end of which is slideably engaged between the dovetail elements and having another end to position the brace element on a planar surface for support of the picture framing device.

20. The device of claim 16 wherein the support means comprises first and second support means, each of the support means comprising a pair of spaced-apart, dovetail-like elements to define a space therebetween, each pair of the dovetail elements of the support means generally at right angles to each other and a plastic brace element, one end of which brace element is slideably engaged within the first or second dovetail support means and having another end to provide support for the device in a vertical or horizontal displayed position.

21. The device of claim 16 wherein the chamfered edge of the backplate means and the undercut edge of the confinement means extends substantially the entire length of the backplate means and the confinement means, and the other edges of the backplate means and the confinement means are straight and the backplate means fits in a snug relationship along all straight edges in the confinement means.

* * * * *